US010971829B2

(12) United States Patent
Hata et al.

(10) Patent No.: US 10,971,829 B2
(45) Date of Patent: Apr. 6, 2021

(54) CONNECTOR AND PACKAGE BODY

(71) Applicants: KYOCERA CORPORATION, Kyoto (JP); TOYOTA JIDOSHA KABUSHIKI KAISHA, Aichi (JP)

(72) Inventors: Tetsuya Hata, Yokohama (JP); Shigeki Ohara, Isehara (JP); Hiroshi Kobayashi, Okazaki (JP); Motoya Hara, Nisshin (JP)

(73) Assignees: KYOCERA CORPORATION, Kyoto (JP); TOYOTA JIDOSHA KABUSHIKI KAISHA, Aichi (JP)

( * ) Notice: Subject to any disclaimer, the term of this patent is extended or adjusted under 35 U.S.C. 154(b) by 0 days.

(21) Appl. No.: 16/615,775

(22) PCT Filed: Apr. 25, 2018

(86) PCT No.: PCT/JP2018/016856
§ 371 (c)(1),
(2) Date: Nov. 21, 2019

(87) PCT Pub. No.: WO2018/216425
PCT Pub. Date: Nov. 29, 2018

(65) Prior Publication Data

US 2020/0091624 A1 Mar. 19, 2020

(30) Foreign Application Priority Data

May 24, 2017 (JP) ..... JP2017-103019

(51) Int. Cl.
*H01R 4/245* (2018.01)
*H01R 13/50* (2006.01)

(52) U.S. Cl.
CPC ..... *H01R 4/245* (2013.01); *H01R 13/501* (2013.01)

(58) Field of Classification Search
CPC ..... H01R 4/2433; H01R 4/2408; H01R 4/34; H01R 4/66; H01R 13/52; H01R 13/5216; Y10S 439/936
See application file for complete search history.

(56) References Cited

U.S. PATENT DOCUMENTS 3,707,040 A 12/1972 Lehmann et al.
5,435,747 A * 7/1995 Franckx ..... H01R 4/2433 439/409
5,561,269 A * 10/1996 Robertson ..... H01R 4/70 174/92

(Continued)

FOREIGN PATENT DOCUMENTS

CN 202481424 U 10/2012
JP H08315902 A 11/1996

(Continued)

*Primary Examiner* — Edwin A. Leon
*Assistant Examiner* — Milagros Jeancharles
(74) *Attorney, Agent, or Firm* — Duane Morris LLP

(57) ABSTRACT

A connector and a package body that can be transported without exposing a filler to the outside and can stably deliver predetermined performance during use are provided. A connector (10) comprises: a pair of a first fitting object (16) and a second fitting object (30); a first opening (29) and a second opening (44) formed respectively in the first fitting object (16) and the second fitting object (30) and opened to a fitting side; and a filler (70) provided inside at least one fitting object of the first fitting object (16) and the second fitting object (30), wherein, before the first fitting object (16) and the second fitting object (30) are fitted together, the filler (70) is located inside of an opening of a corresponding fitting object, and an end surface of the second fitting object (30) on the fitting side forms a plane.

9 Claims, 13 Drawing Sheets

(56) References Cited

U.S. PATENT DOCUMENTS 5,690,505 A * 11/1997 Hirata ..... H01R 4/2433 439/402
5,727,965 A * 3/1998 Yagi ..... H01R 4/2454 439/402
5,762,517 A * 6/1998 Abe ..... H01R 4/2433 439/402
5,961,341 A * 10/1999 Knowles ..... H01R 4/2433 439/403
6,196,863 B1 * 3/2001 Schwant ..... H01R 12/67 439/417
6,769,931 B2 * 8/2004 Negishi ..... H01R 4/2433 439/402
7,384,297 B2 * 6/2008 King, Jr. ..... H02G 3/081 439/369
2007/0099484 A1 * 5/2007 Scheer ..... H01R 12/675 439/492
2008/0081507 A1 * 4/2008 Mahajan ..... H01R 4/2406 439/410
2008/0293288 A1 * 11/2008 Caveney ..... H01R 9/031 439/404
2010/0300927 A1 12/2010 Ouimette et al.
2018/0277984 A1 * 9/2018 Hata ..... H01R 13/506
2019/0006790 A1 * 1/2019 Hata ..... H01R 13/58
2019/0296453 A1 * 9/2019 Hata ..... H01R 4/24
2019/0319372 A1 * 10/2019 Hata ..... H01R 13/5216

FOREIGN PATENT DOCUMENTS

JP 3028988 B2 2/2000
JP 31 I 9119 B2 10/2000
JP 2000322940 A 11/2000
JP 2005251400 A 9/2005
JP 5966041 B1 7/2016
WO WO2017046982 A1 3/2017

* cited by examiner

CONNECTOR AND PACKAGE BODY

CROSS REFERENCE TO RELATED APPLICATION

This application claims priority to and the benefit of Japanese Patent Application No. 2017-103019 filed on May 24, 2017, the entire disclosure of which is incorporated herein by reference.

TECHNICAL FIELD

The present disclosure relates to a connector and a package body for packing the connector.

BACKGROUND

A conventionally known connector has the following structure: A filler is provided on each of a pair of fitting objects to be fitted together, thus protecting a contact portion in a corresponding contact from entry of external foreign matter such as water or dust when the pair of fitting objects are fitted together.

For example, PTL 1 discloses a connector that has a drip-proof structure by causing a pair of elastic annular members of a grommet to adhere to each other when fitting a cover and a main body together.

CITATION LIST

Patent Literature

PTL 1: JP 3028988 B2

SUMMARY

Technical Problem

However, in the case where a filler is provided on each of a pair of fitting objects before fitting, the filler may come into contact with an external component or foreign matter during operation or transportation. This can cause the filler to be deformed into an unintended shape or cause foreign matter to adhere to the surface, rendering predetermined performance unobtainable. If the filler is exposed to external light, the properties of the filler are likely to change. Accordingly, to protect the filler particularly during transportation, a connector and a package body that can prevent the filler from coming into contact with an external component or foreign matter and prevent the filler from being exposed to external light are desired.

It would therefore be desirable to provide a connector that can be transported without exposing a filler to the outside and can stably deliver predetermined performance during use, and a package body for the connector.

Solution to Problem

To solve the problem stated above, a connector according to a first aspect is a connector comprising: a pair of a first fitting object and a second fitting object; a first opening and a second opening formed respectively in the first fitting object and the second fitting object and opened to a fitting side; and a filler provided inside at least one fitting object of the first fitting object and the second fitting object, wherein, before the first fitting object and the second fitting object are fitted together, the filler is located inside of an opening of a corresponding fitting object, and an end surface of the second fitting object on the fitting side forms a plane.

A connector according to a second aspect may comprise a connection portion connecting the first fitting object and the second fitting object, wherein the end surface of the second fitting object on the fitting side and a surface of the connection portion form a common first plane.

In a connector according to a third aspect, the first fitting object may protrude in a direction opposite to a protruding direction of the second fitting object with respect to the first plane.

In a connector according to a fourth aspect, the filler may be provided inside each of the first fitting object and the second fitting object.

In a connector according to a fifth aspect, one fitting object of the first fitting object and the second fitting object may include a contact having an electrically conductive portion, and before the first fitting object and the second fitting object are fitted together, the contact may be located inward from an end of the fitting object on the fitting side.

In a connector according to a sixth aspect, the electrically conductive portion may be a press-contact groove, and when the first fitting object and the second fitting object are fitted together, the contact may clamp a core wire of each of at least two cables by the press-contact groove to bring the at least two cables into conduction with each other.

To solve the problem stated above, a package body according to a seventh aspect is a package body for packing any of the connectors described above in a state before the first fitting object and the second fitting object are fitted together, the package body being light blocking, and comprising a cover surface that faces the filler provided inside the corresponding fitting object and covers the corresponding opening in a state in which the connector is packed in the package body.

A package body according to an eighth aspect may comprise a support surface that supports the end surface of the second fitting object on the fitting side in a state in which the connector is packed in the package body.

In a package body according to a ninth aspect, the support surface may support a common first plane formed by the end surface of the second fitting object on the fitting side and a surface of a connection portion connecting the first fitting object and the second fitting object.

In a package body according to a tenth aspect, the cover surface that covers the second opening and the support surface may form a common second plane.

A package body according to an eleventh aspect may comprise a recess recessed from the support surface in a stepwise manner, wherein the first fitting object is contained in the recess.

In a package body according to a twelfth aspect, the cover surface that covers the first opening may be formed by an inner surface of the recess, and a spacing between the cover surface and the support surface may be approximately same as a spacing between an end of the first fitting object on the fitting side and the end surface of the second fitting object on the fitting side.

Advantageous Effect

A connector and a package body according to an embodiment of the present disclosure can be transported without exposing a filler to the outside and can stably deliver predetermined performance during use.

DETAILED DESCRIPTION

Figure 1:
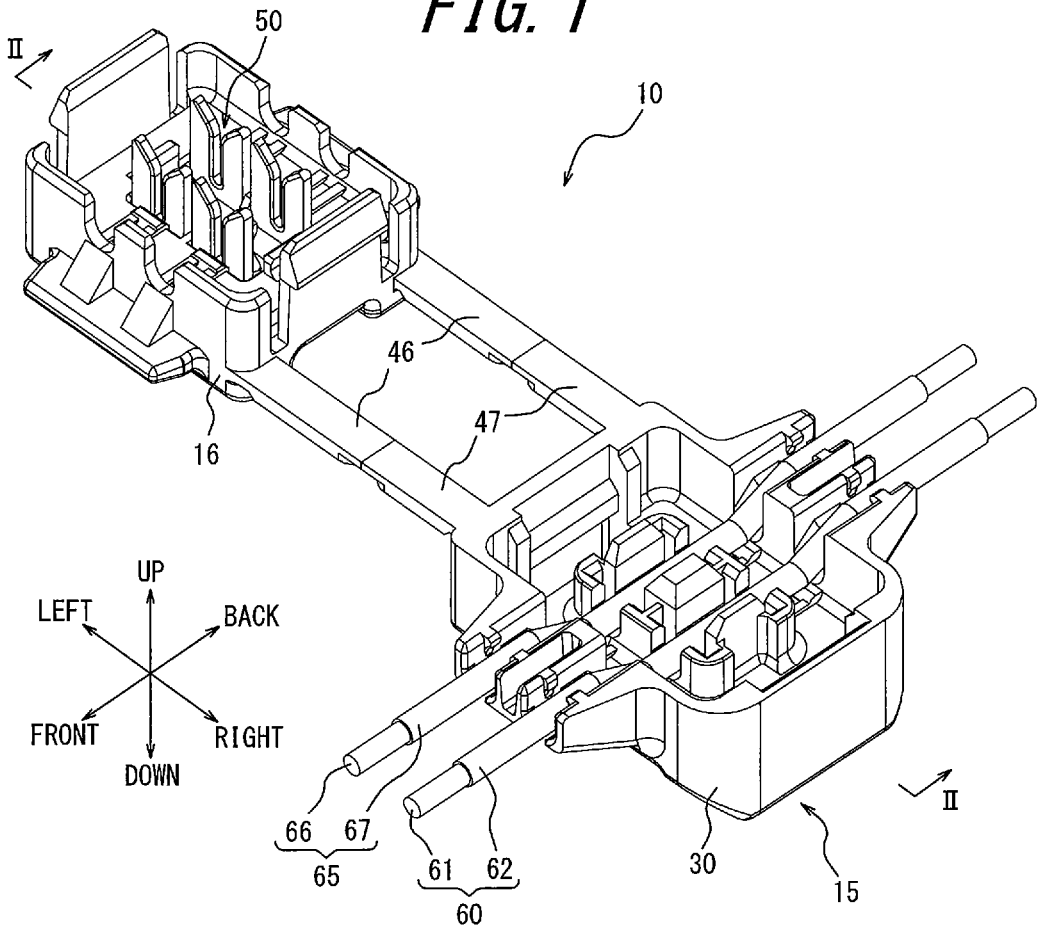
FIG. 1 is a perspective view of a connector, a first cable, and a second cable according to an embodiment when an insulation housing is in an expanded state.

An embodiment of the present disclosure will be described hereinafter with reference to attached drawings. The directions such as front, back, right, left, up, and down in the following description are based on the directions of the arrows in the drawings.

(Connector)

The structure of a connector 10 in a state in which a filler 70 is not loaded will be mainly described below.

Figure 2:
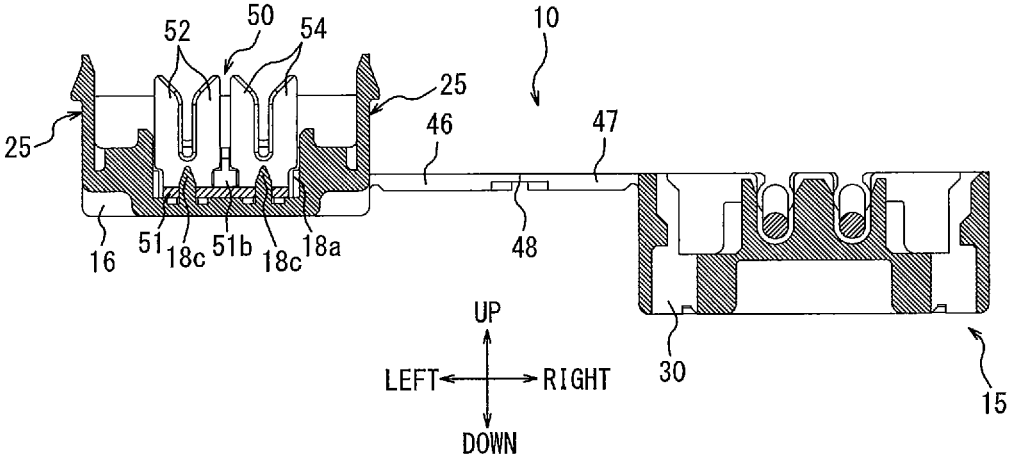
FIG. 2 is a sectional view along arrow II-II in FIG. 1.

FIG. 1 is a perspective view of a connector 10, a first cable 60, and a second cable 65 according to an embodiment when an insulation housing 15 is in an expanded state. FIG. 2 is a sectional view along arrow II-II in FIG. 1. The connector 10 according to this embodiment includes the insulation housing 15 and a relay contact 50 (contact) as main structural elements.

The insulation housing 15 is, for example, a molded component made of an insulating synthetic resin material. The insulation housing 15 includes a first split housing 16 (first fitting object) and a second split housing 30 (second fitting object). The insulation housing 15 includes first connection portions 46 and second connection portions 47 (connection portions) as a connection that connects the first split housing 16 and the second split housing 30. The insulation housing 15 includes the first split housing 16, the second split housing 30, the first connection portions 46, and the second connection portions 47, which are integrally formed.

The relay contact 50 is provided, for example, in the first split housing 16. As illustrated in FIG. 2, before the first split housing 16 and the second split housing 30 are fitted together, the relay contact 50 is located in the first split housing 16 inward from the upper end (the end on the fitting side) of the first split housing 16. For example, the relay contact 50 is located in the first split housing 16 inward from the tip of a first locking portion 25 of the first split housing 16 (described later). In other words, the upper end of the relay contact 50 is lower than the upper end of the first locking portion 25.

Figure 3:
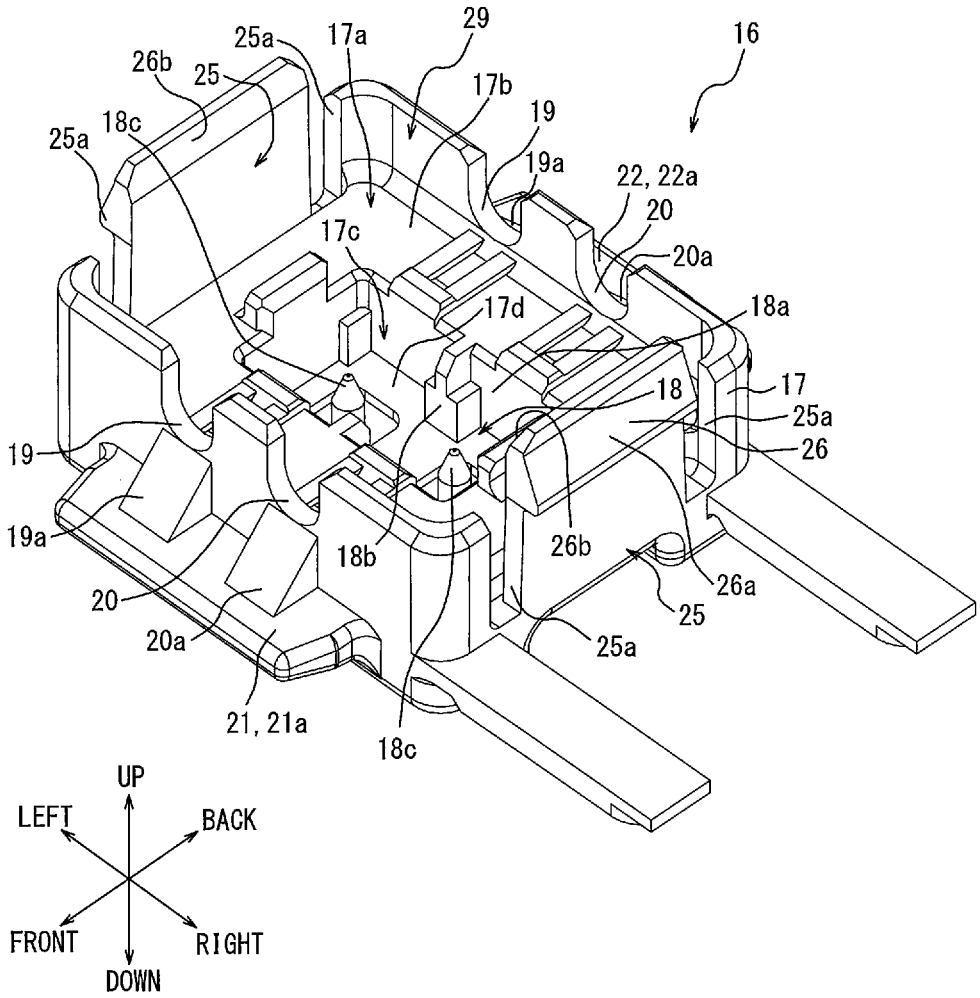
FIG. 3 is an enlarged perspective view of a first split housing in a state in which a relay contact is not fitted.

FIG. 3 is an enlarged perspective view of the first split housing 16 in a state in which the relay contact 50 is not fitted. The structure of the first split housing 16 will be described in detail below, with reference to FIG. 3.

The outer peripheral edges of one surface (the upper surface in FIG. 3) of the first split housing 16 in the thickness direction are formed by an outer peripheral wall 17. The part of the first split housing 16 on the inner peripheral side of the outer peripheral wall 17 is formed by an inner peripheral recess 17*a* that is recessed downward from the upper surface of the first split housing 16 in a stepwise manner. The bottom surface of the inner peripheral recess 17*a* is formed by an inner peripheral first facing surface 17*b* that is a plane parallel to the upper surface of the first split housing 16. The central part on the inner peripheral side of the inner peripheral first facing surface 17*b* is formed by a central first recess 17*c* that is recessed downward from the inner peripheral first facing surface 17*b* in a stepwise manner. The bottom surface of the central first recess 17*c* is formed by a central first facing surface 17*d* that is a plane parallel to the inner peripheral first facing surface 17*b*. The central first recess 17*c* and the central first facing surface 17*d* form a contact mounting groove 18. The contact mounting groove 18 has a fixed portion 18*a*, and an intermediate projection 18*b* that is located in the middle of the fixed portion 18*a* in the right-left direction to narrow the front-back width of the fixed portion 18*a* and delimit the fixed portion 18*a* into a pair of right and left fixed portions. A positioning protrusion 18*c* having an approximately cylindrical shape protrudes from the bottom surface (central first facing surface 17*d*) of the pair of fixed portions 18*a*.

The outer peripheral wall 17 of the first split housing 16 has a pair of first cable mounting grooves 19 that are located on the front and back sides of one fixed portion 18*a* and are colinear. The outer peripheral wall 17 of the first split housing 16 also has a pair of second cable mounting grooves 20 that are located on the front and back sides of the other fixed portion 18*a* and are colinear. The second cable mounting grooves 20 are parallel to the first cable mounting grooves 19. The front shape of the first cable mounting grooves 19 and the second cable mounting grooves 20 is semi-circular. A pair of slopes 19*a* that are inclined toward the outside in the downward direction from the deepest bottom surfaces of the pair of first cable mounting grooves 19 are provided at the front and back surfaces of the outer peripheral wall 17 of the first split housing 16. Likewise, a pair of slopes 20*a* that are inclined toward the outside in the downward direction from the deepest bottom surfaces of the pair of second cable mounting grooves 20 are provided at the front and back surfaces of the outer peripheral wall 17 of the first split housing 16. Platelike lid portions 21 and 22 extending in the front-back direction from a position below the front and back slopes 19*a* and 20*a* are provided at the front and back surfaces of the outer peripheral wall 17 of the first split housing 16. Facing surfaces 21*a* and 22*a* of the lid portions 21 and 22 are at the same height as the lowest parts of the slopes 19*a* and 20*a*.

A pair of first locking portions 25 having elasticity are formed at the right and left side surfaces of the outer peripheral wall 17 of the first split housing 16. A pair of recesses 25*a* are formed between each first locking portion 25 and the front and back surfaces of the outer peripheral wall 17. Each first locking portion 25 has a first locking protrusion 26 protruding outward from the side surface of the first split housing 16. Each first locking protrusion 26 extends in the front-back direction. Each first locking protrusion 26 has a slope 26*a* that is inclined toward the outside of the first split housing 16 in the downward direction. Each first locking portion 25 has a slope 26*b* that is formed at the upper edge of the inner surface and inclined toward the inside of the first split housing 16 in the downward direction.

The first split housing 16 has a first opening 29 which opens to the fitting side, i.e. an upward opening. The first opening 29 is bordered by the outer peripheral wall 17 and faces the inner peripheral first facing surface 17*b* and the central first facing surface 17*d*.

Figure 4:
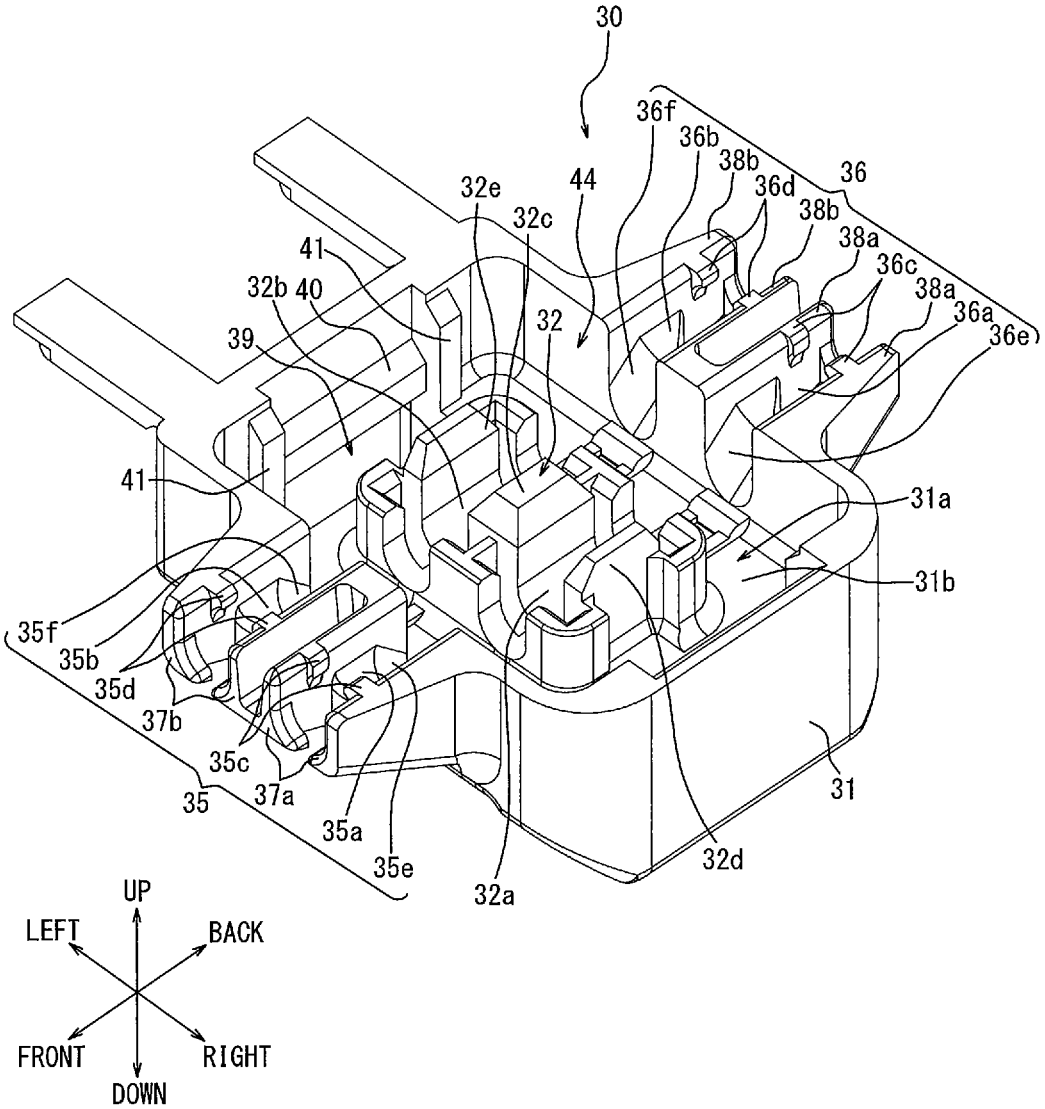
FIG. 4 is an enlarged perspective view of a second split housing.

FIG. 4 is an enlarged perspective view of the second split housing 30. The structure of the second split housing 30 will be described in detail below, with reference to FIG. 4.

An outer peripheral wall 31 protrudes at the outer peripheral edges of one surface (the upper surface in FIG. 4) of the second split housing 30 in the thickness direction. The part of the second split housing 30 on the inner peripheral side of the outer peripheral wall 31 is formed by an inner peripheral recess 31*a* that is recessed from the upper edges of the outer peripheral wall 31 in a stepwise manner. The bottom surface of the inner peripheral recess 31*a* is formed by an inner peripheral second facing surface 31*b* that is a plane parallel to the upper surface of the second split housing 30. A cable pressing protrusion 32 having a pair of a first pressing groove 32*a* and a second pressing groove 32*b* on the right and left sides and U-shaped in cross section is formed at the inner peripheral second facing surface 31*b*. The cable pressing protrusion 32 has a central protrusion 32*c* and protrusions 32*d* and 32*e* on the right and left sides. The first pressing groove 32*a* is formed between the central protrusion 32*c* and the protrusion 32*d*. The second pressing groove 32*b* is formed between the central protrusion 32*c* and the protrusion 32*e*.

Cable support arm portions 35 and 36 protrude from the front and back surfaces of the second split housing 30. First cable holding grooves 35*a* and 36*a* and second cable holding grooves 35*b* and 36*b* are formed on the upper surfaces of the cable support arm portions 35 and 36. The front end part and the back end part of the first cable holding groove 35*a* in the cable support arm portion 35 at the front are formed by a pair of protrusion parts 37*a* separated right and left by a gap, and the front end part and the back end part of the first cable holding groove 36*a* in the cable support arm portion 36 at the back are formed by a pair of protrusion parts 38*a* separated right and left by a gap. Likewise, the front end part and the back end part of the second cable holding groove 35*b* in the cable support arm portion 35 at the front are formed by a pair of protrusion parts 37*b* separated right and left by a gap, and the front end part and the back end part of the second cable holding groove 36*b* in the cable support arm portion 36 at the back are formed by a pair of protrusion parts 38*b* separated right and left by a gap. The pairs of protrusion parts 37*a*, 38*a*, 37*b*, and 38*b*, in particular the outer protrusion parts on the right and left sides of the cable support arm portions 35 and 36, elastically flex in the right-left direction, and the spacing between the adjacent protrusion parts is variable. Claw portions facing each other protrude from the lower end of the front and back ends of each of the pairs of protrusion parts 37*a*, 38*a*, 37*b*, and 38*b*.

The first cable holding grooves 35*a* and 36*a* and the second cable holding grooves 35*b* and 36*b* have a depth sufficient to insert and hold the first cable 60 and the second cable 65 for the whole diameter (i.e. the whole diameter can fit in). The first cable holding grooves 35*a* and 36*a* respectively have slopes 35*e* and 36*e* that are inclined upward in the outward direction. When the first cable 60 is inserted and held in the first cable holding grooves 35*a* and 36*a*, the corresponding cable parts of the first cable 60 are inclined obliquely in the vertical direction along the slopes 35*e* and 36*e* of the first cable holding grooves 35*a* and 36*a*, as illustrated in FIG. 1. Likewise, the second cable holding grooves 35*b* and 36*b* respectively have slopes 35*f* and 36*f*, and the second cable 65 is inserted and held in the second cable holding grooves 35*b* and 36*b* in the same manner as the first cable 60.

A pair of anti-dropout protrusions 35*c* and a pair of anti-dropout protrusions 36*c* are provided near the openings in the upper part of the front and back ends of the first cable holding grooves 35*a* and 36*a* (i.e. the facing surfaces of the protrusion parts 37*a* and 38*a*). Likewise, a pair of anti-dropout protrusions 35*d* and a pair of anti-dropout protrusions 36*d* are provided near the openings in the upper part of the front and back ends of the second cable holding grooves 35*b* and 36*b* (i.e. the facing surfaces of the protrusion parts 37*b* and 38*b*). The anti-dropout protrusions 35*c*, 36*c*, 35*d*, and 36*d* allow the first cable 60 and the second cable 65 to be inserted respectively into the first cable holding grooves 35*a* and 36*a* and the second cable holding grooves 35*b* and 36*b*. Here, the pairs of protrusion parts 37*a* and 38*a* and the pairs of protrusion parts 37*b* and 38*b* flex so as to widen the spacing in the right-left direction (the spacing of each of the pairs of anti-dropout protrusions 35*c*, 36*c*, 35*d*, and 36*d*).

When the first cable 60 and the second cable 65 are inserted into the first cable holding grooves 35*a* and 36*a* and the second cable holding grooves 35*b* and 36*b*, the pairs of anti-dropout protrusions 35*c* and 36*c* clamp the first cable 60 and the pairs of anti-dropout protrusions 35*d* and 36*d* clamp the second cable 65. The pairs of protrusion parts 37*a* and 38*a* and the pairs of protrusion parts 37*b* and 38*b* elastically flex in a direction which narrows the spacing in the right-left direction. Hence, the pairs of protrusion parts 37*a* and 38*a* and the pairs of protrusion parts 37*b* and 38*b* allow the first cable 60 and the second cable 65 inserted respectively in the first cable holding grooves 35*a* and 36*a* and the second cable holding grooves 35*b* and 36*b* to move in the cable extending direction, while applying resistance. At the same time, the pairs of protrusion parts 37*a* and 38*a* and the pairs of protrusion parts 37*b* and 38*b* function as retainers by applying resistance to a force which attempts to separate the first cable 60 and the second cable 65 from the first cable holding grooves 35*a* and 36*a* and the second cable holding grooves 35*b* and 36*b*, thus preventing the first cable 60 and the second cable 65 from coming out easily, while allowing the first cable 60 and the second cable 65 to separate from the first cable holding grooves 35*a* and 36*a* and the second cable holding grooves 35*b* and 36*b* when subjected to at least a predetermined external force. This retention function is maintained even if the second split housing 30 is turned upside down.

A pair of second locking portions 39 are formed on the right and left side surfaces of the outer peripheral wall 31 of the second split housing 30. The pair of second locking portions 39 are each formed on the inner surface of the second split housing 30. Each second locking portion 39 has a second locking protrusion 40 protruding inward from the side surface of the second split housing 30. A pair of projection walls 41 extending in the up-down direction are formed at the front and back ends of each second locking portion 39. Each second locking protrusion 40 has an approximately rectangular parallelepiped shape and is formed on the inner surface of the second split housing 30 so as to extend between the pair of projection walls 41. Each second locking protrusion 40 extends in the front-back direction.

The end surface on the fitting side, i.e. the upper surface, of the second split housing 30 is planar. The second split housing 30 has a second opening 44 which opens to the fitting side, i.e. an upward opening. The second opening 44 is bordered by the outer peripheral wall 31 and faces the inner peripheral second facing surface 31*b*. Since the upper surface of the outer peripheral wall 31 is planar, the second opening 44 is also planar.

Figure 5:
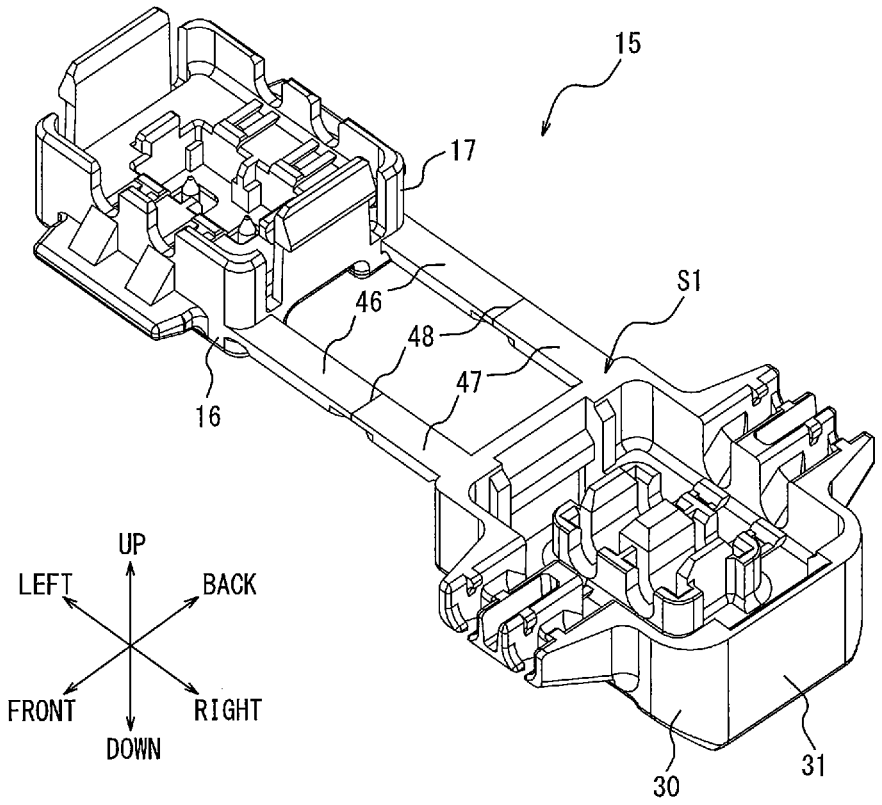
FIG. 5 is a perspective view of the whole insulation housing in a state in which the relay contact is not fitted.

FIG. 5 is a perspective view of the whole insulation housing 15 in a state in which the relay contact 50 is not fitted.

The first split housing 16 and the second split housing 30 are connected by a pair of the first connection portions 46 at the front and the back linearly extending from the first split housing 16 side, a pair of the second connection portions 47 at the front and the back linearly extending from the second split housing 30 side, and bendable portions 48. The bendable portions 48 connect the first connection portions 46 and the second connection portions 47. In an expanded state, the pair of first connection portions 46 at the front and the back and the pair of second connection portions 47 at the front and the back are situated in the same plane.

As illustrated in FIGS. 2 and 5, the bendable portions 48 are thinner than the first connection portions 46 and the second connection portions 47 at the front and the back. The first connection portions 46 and the second connection portions 47 at the front and the back can be (easily) valley-folded (bent in the direction in which the first split housing 16 and the second split housing 30 approach each other) in FIGS. 1, 5, etc., with the bendable portions 48 extending in the front-back direction as a folding line. The first connection portions 46 have lower bending rigidity than the second connection portions 47.

In the expanded state illustrated in FIGS. 1 and 5, the first split housing 16, the first connection portions 46, the bendable portions 48, the second connection portions 47, and the second split housing 30 have strength (rigidity) sufficient to autonomously maintain this expanded state.

In FIG. 5, for example, the upper surface (the end surface on the fitting side) of the second split housing 30 and the surfaces (in particular the upper surfaces) of the first connection portions 46 and the second connection portions 47 form a common first plane S1. The first split housing 16 protrudes in a direction opposite to the protruding direction of the second split housing 30, with respect to the upper surfaces of the first connection portions 46 and the second connection portions 47. The first split housing 16 protrudes upward with respect to the first plane S1, whereas the second split housing 30 protrudes downward with respect to the first plane S1. More specifically, the outer peripheral wall 17 of the first split housing 16 and the outer peripheral wall 31 of the second split housing 30 protrude in opposite directions in the up-down direction, with respect to the first plane S1.

Figure 6:
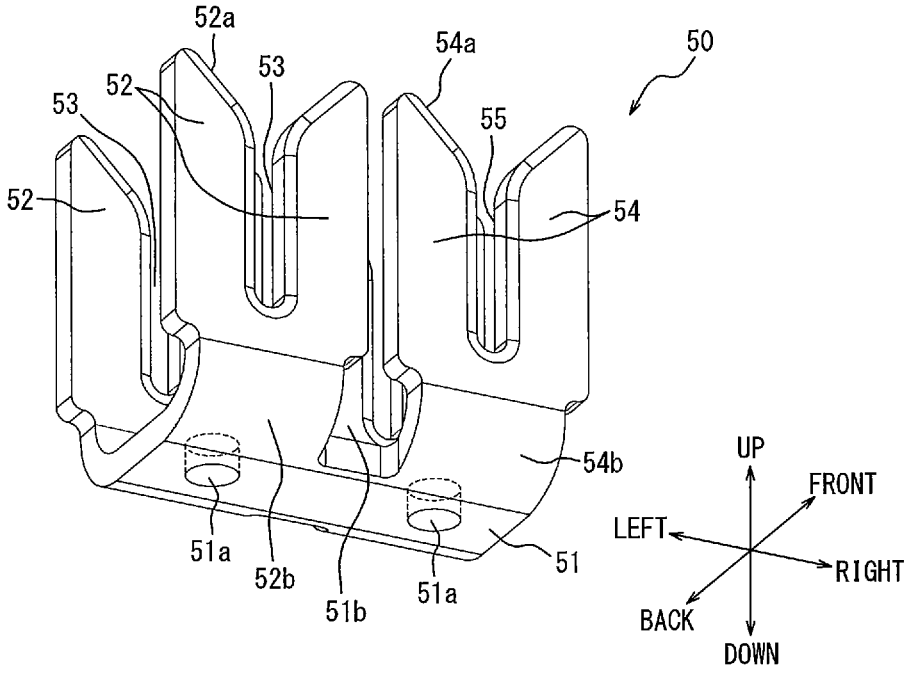
FIG. 6 is a perspective view of the relay contact in isolation.

FIG. 6 is a perspective view of the relay contact 50 in isolation. The structure of the relay contact 50 will be described in detail below, with reference to FIG. 6.

The relay contact 50 is obtained by forming a thin plate of a copper alloy (e.g. phosphor bronze, beryllium copper, titanium copper) or a corson copper alloy having spring elasticity into the illustrated shape using progressive molding (stamping). The surface of the relay contact 50 is nickel-plated to form a base, and then tin-copper-plated or tin-plated (or gold-plated).

The relay contact 50 integrally includes a platelike base piece 51 extending in the right-left direction, a pair of platelike first cable press-contact pieces 52 protruding at one end of the front and back edges of the base piece 51 and extending in a direction orthogonal to the base piece 51, and a pair of platelike second cable press-contact pieces 54 protruding at the other end of the front and back edges of the base piece 51 and extending in the direction orthogonal to the base piece 51. A circular positioning hole 51*a* is formed at each of two locations right and left in the base piece 51. The first cable press-contact pieces 52 at the front and the back each have a first press-contact groove 53 formed by a slit linearly extending toward the base piece 51, and the second cable press-contact pieces 54 at the front and the back each have a second press-contact groove 55 formed by a slit linearly extending toward the base piece 51. The upper opening of the first press-contact groove 53 is approximately V-shaped by a tip 52*a*, i.e. shaped to widen upward. The upper opening of the second press-contact groove 55 is approximately V-shaped by a tip 54*a*, i.e. shaped to widen upward.

The pair of first cable press-contact pieces 52 and the pair of second cable press-contact pieces 54 at the front and the back are respectively connected to the base piece 51 via narrow portions (constricted portions) 52*b* and 54*b*. The spacing between the facing edges of the first cable press-contact piece 52 and the second cable press-contact piece 54 arranged in the right-left direction is smaller than the spacing between the facing edges of the narrow portion 52*b* and the narrow portion 54*b*. A play portion 51*b* is provided between the narrow portion 52*b* and the narrow portion 54*b*. No other members, such as an insulator, are between the first cable press-contact piece 52 and the second cable press-contact piece 54.

In a state in which the first split housing 16 and the second split housing 30 are fitted together, the relay contact 50 is in a state of being electrically connected to the first cable 60 and the second cable 65. More specifically, when fitting the first split housing 16 and the second split housing 30 together, the relay contact 50 brings the first cable 60 and the second cable 65 into conduction with each other by cutting of the insulating sheaths 62 and 67 respectively by the first press-contact groove 53 and the second press-contact groove 55. At the time of fitting, the relay contact 50 clamps core wires 61 and 66 respectively by the first press-contact groove 53 and the second press-contact groove 55, to bring the first cable 60 and the second cable 65 into conduction with each other.

The first cable 60 and the second cable 65 are formed by covering the surfaces of the core wires 61 and 66 (stranded wires or single wires) made of a conductive and flexible material (e.g. copper or aluminum) respectively with the flexible and insulating tubular sheaths 62 and 67. The first cable 60 is a cable that is provided inside a wiring object (e.g. an automobile) from the beginning and is connected to a power source of the wiring object. The second cable 65 is a cable that is subsequently connected to the first cable 60 as an addition. One end (front end) of the second cable 65 is connected to, for example, an electronic device or an electrical device (e.g. a car navigation system).

Figure 7:
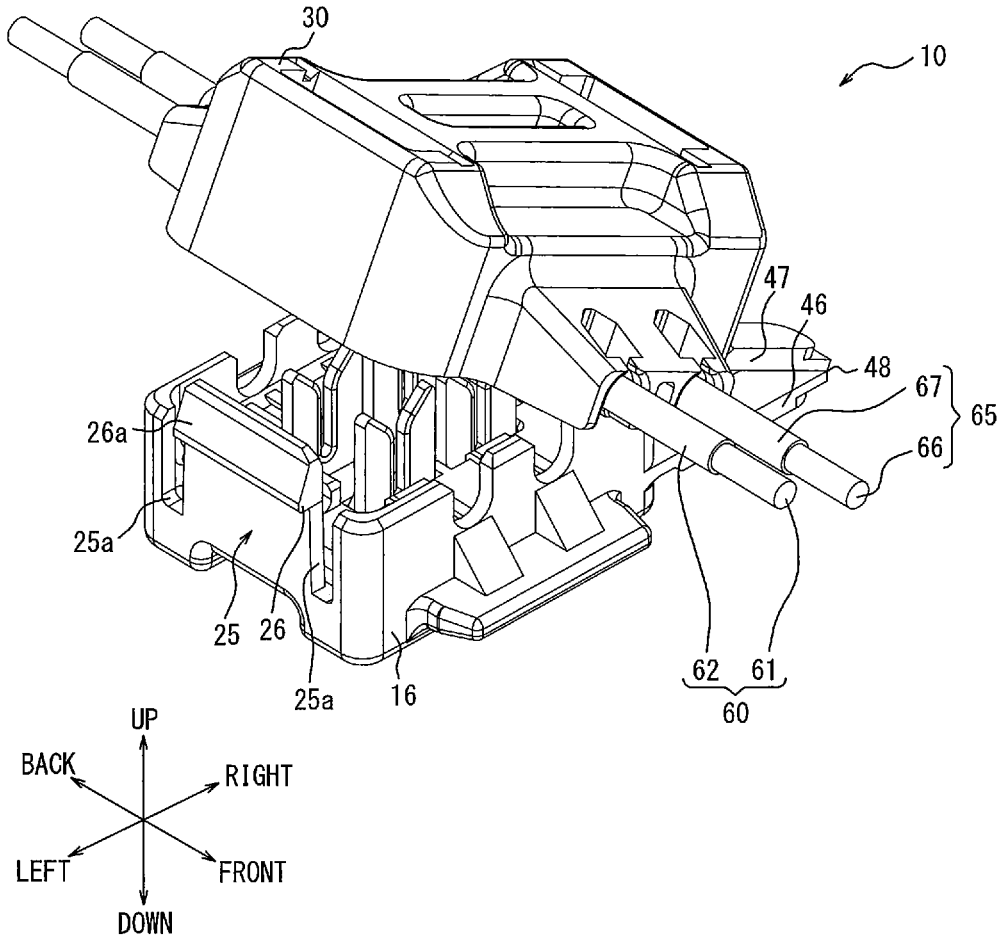
FIG. 7 is a perspective view of the connector, the first cable, and the second cable in a stage in which the insulation housing transitions from the expanded state to a locked state.
Figure 8:
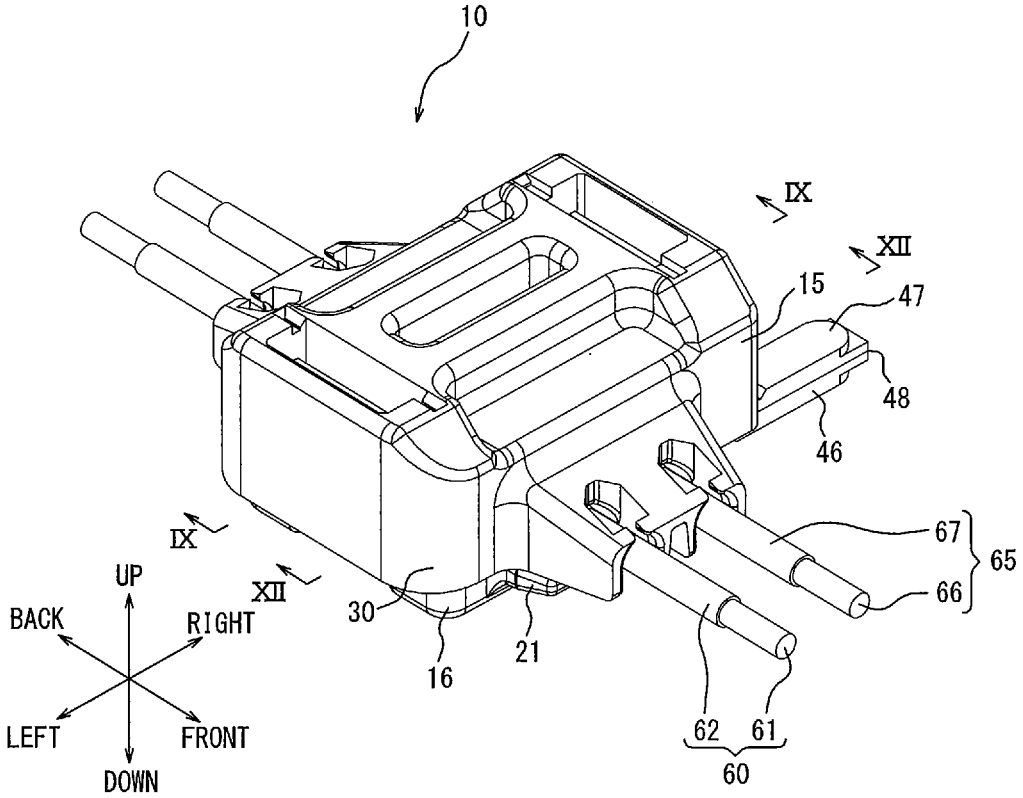
FIG. 8 is a perspective view of the connector, the first cable, and the second cable when the insulation housing is in the locked state.
Figure 9:
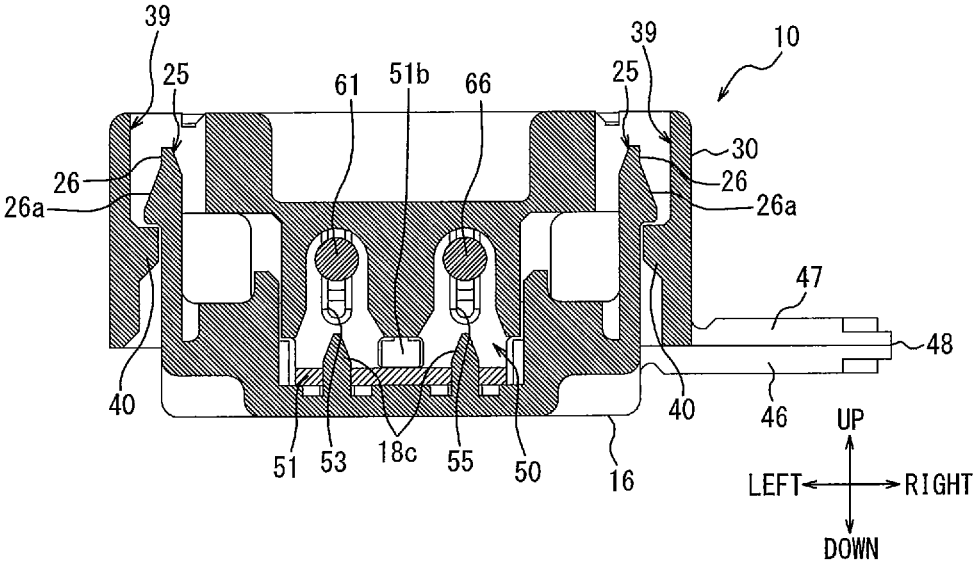
FIG. 9 is a sectional view along arrow IX-IX in FIG. 8.

FIG. 7 is a perspective view of the connector 10, the first cable 60, and the second cable 65 in a stage in which the insulation housing 15 transitions from the expanded state to a locked state. FIG. 8 is a perspective view of the connector 10, the first cable 60, and the second cable 65 when the insulation housing 15 is in the locked state. FIG. 9 is a sectional view along arrow IX-IX in FIG. 8.

To assemble the connector 10 by integrating the insulation housing 15, the relay contact 50, the first cable 60, and the second cable 65 while electrically connecting the first cable 60 and the second cable 65, an assembly operator fits the lower part of the relay contact 50 into the contact mounting groove 18 of the first split housing 16 in the expanded state illustrated in FIGS. 1 and 5, for example by hand. Specifically, the base piece 51 is fitted into the bottom of the contact mounting groove 18, with the intermediate projection 18*b* being fitted into the play portion 51*b*. The base piece 51-side half part (lower half part in FIGS. 1 and 2) of the first cable press-contact pieces 52 is fitted into the corresponding fixed portion 18*a*. The base piece 51-side half part of the second cable press-contact pieces 54 is fitted into the corresponding fixed portion 18*a*. The pair of positioning protrusions 18*c* of the first split housing 16 are fitted into the pair of positioning holes 51*a* of the base piece 51 (see FIGS. 2 and 9), so that the relay contact 50 is positioned relative to the first split housing 16. When the relay contact 50 is mounted in the first split housing 16, the first press-contact grooves 53 at the front and the back are located on an axis through the first cable mounting grooves 19 at the front and the back, and the second press-contact grooves 55 at the front and the back are located on an axis through the second cable mounting grooves 20 at the front and the back.

The assembly operator pushes the first cable 60 and the second cable 65 in against the resistance of the anti-dropout protrusions 35*c*, 36*c*, 35*d*, and 36*d* at the front and the back, for example by hand (see FIG. 1). Here, the protrusion parts 37*a*, 38*a*, 37*b*, and 38*b* flex against elastic force, and widen the spacing between the facing anti-dropout protrusions 35*c*, 36*c*, 35*d*, and 36*d*. When the first cable 60 and the second cable 65 are pushed respectively into the first cable holding grooves 35*a* and 36*a* and the second cable holding grooves 35*b* and 36*b*, the spacing between the facing anti-dropout protrusions 35*c*, 36*c*, 35*d*, and 36*d* narrows. Hence, the first cable 60 and the second cable 65 are clamped respectively between the bottom of the first cable holding grooves 35*a* and 36*a* and the anti-dropout protrusions 35*c* and 36*c* and between the bottom of the second cable holding grooves 35*b* and 36*b* and the anti-dropout protrusions 35*d* and 36*d*. The first cable 60 and the second cable 65 are thus movable in the cable extending direction while being subjected to resistance. This enables positioning of the first cable 60 and the second cable 65 in the extending direction relative to the connector 10 in the expanded state illustrated in FIGS. 1 and 2. If the first cable 60 and the second cable 65 try to separate respectively from the first cable holding grooves 35*a* and 36*a* and the second cable holding grooves 35*b* and 36*b*, the first cable 60 and the second cable 65 are subjected to resistance that prevents the separation. Therefore, even when the connector 10 is turned upside down, the first cable 60 and the second cable 65 do not easily fall out of the first cable holding grooves 35*a* and 36*a* and the second cable holding grooves 35*b* and 36*b* respectively. The first cable 60 and the second cable 65 can be separated respectively from the first cable holding grooves 35*a* and 36*a* and the second cable holding grooves 35*b* and 36*b*, by at least a predetermined biasing force. Thus, the connector 10 can be replaced easily, and the first cable 60 and the second cable 65 attached to and removed from the connector 10 can be changed easily.

In a state in which the first cable 60 and the second cable 65 are arranged in the right-left direction and fitted and held respectively in the first cable holding grooves 35*a* and 36*a* and the second cable holding grooves 35*b* and 36*b*, the second split housing 30 (the second connection portions 47 at the front and the back) is rotated about the bendable portions 48 at the front and the back so as to approach the first split housing 16 (the first connection portions 46 at the front and the back). As a result, the second locking protrusions 40 on the first split housing 16 side abut the slopes 26*a* of the corresponding first locking protrusions 26. When the second split housing 30 is further rotated, the second locking protrusions 40 slide downward on the corresponding slopes 26*a*, and the corresponding first locking protrusions 26 elastically deform in the inward direction of the first split housing 16. The second pressing groove 32*b* of the cable pressing protrusion 32 located on the second connection portion 47 side slightly pushes the intermediate part of the second cable 65 into the second press-contact grooves 55 (downward). Consequently, the intermediate part of the second cable 65 enters the space between the second cable press-contact pieces 54 at the front and the back.

The assembly operator further rotates the second split housing 30 about the bendable portions 48 at the front and the back such that it approaches the first split housing 16, for example by hand. The first pressing groove 32*a* of the cable pressing protrusion 32 on the side opposite to the second connection portions 47 presses the intermediate part of the first cable 60 against the tips 52*a* of the first cable press-contact pieces 52 in the extending direction of the first press-contact grooves 53 or in a direction close to the extending direction. The first cable 60 is thus clamped by the tips 52*a* and the cable pressing protrusion 32.

After mounting the first cable 60 and the second cable 65 in the tips 52*a* and 54*a* of the relay contact 50, the first split housing 16 and the second split housing 30 are pressed approximately in parallel in a direction in which the first split housing 16 and the second split housing 30 approach each other, using a general tool (e.g. a pair of pliers) (not illustrated). Each second locking protrusion 40 engages with the corresponding first locking protrusion 26. Each projection wall 41 of the second locking portion 39 is fitted into the corresponding recess 25*a*. Thus, the first split housing 16 is contained in the second split housing 30, and the first locking portion 25 and the second locking portion 39 engage with each other inside the first split housing 16 and the second split housing 30 fitted together.

The cable pressing protrusion 32 further pushes the intermediate parts of the first cable 60 and the second cable 65 respectively into the first press-contact grooves 53 and the second press-contact grooves 55 (toward the bottom surface). Hence, the first cable 60 is pushed from the tips 52*a* to approximately the center of the first press-contact grooves 53. The second cable 65 is pushed from the tips 54*a* to approximately the center of the second press-contact grooves 55. Here, the direction in which the first pressing groove 32*a* and the second pressing groove 32*b* of the cable pressing protrusion 32 respectively press the first cable 60 and the second cable 65 is approximately parallel to the up-down direction (the extending direction of the first press-contact grooves 53 and the second press-contact grooves 55). As a result, the inner surfaces (right and left surfaces) of the first press-contact grooves 53 break the right and left parts of the sheath 62 of the first cable 60, and the inner surfaces (right and left surfaces) of the second press-contact grooves 55 break the right and left parts of the sheath 67 of the second cable 65. Accordingly, when the insulation housing 15 is held in the closed state, the inner surfaces (pair of facing surfaces) of the first press-contact grooves 53 are in contact (press contact) with both sides of the core wire 61 uniformly and reliably, and the inner surfaces (pair of facing surfaces) of the second press-contact grooves 55 are in contact (press contact) with both sides of the core wire 66 uniformly and reliably. Consequently, the core wire 61 of the first cable 60 and the core wire 66 of the second cable 65 are in electrical conduction with each other via the relay contact 50 in the connector 10.

Since the inner surfaces of the first press-contact grooves 53 and the second press-contact grooves 55 do not press against either side of the core wires 61 and 66 too strongly, part of the core wires 61 and 66 is prevented from being cut respectively by the first press-contact grooves 53 and the second press-contact grooves 55. This suppresses a decrease in the mechanical strength of the core wires 61 and 66. Therefore, even when a tensile force acts on the first cable 60 and the second cable 65, the core wires 61 and 66 are unlikely to be completely cut. The reliability of contact between each of the first cable 60 and the second cable 65 and the relay contact 50 can thus be enhanced.

When the first split housing 16 and the second split housing 30 are held (locked) in the closed state (as a result of being fitted together), the facing surfaces 21*a* and 22*a* of the lid portions 21 and 22 of the first split housing 16 block part of the openings (the upward openings in FIG. 4) of the first cable holding grooves 35*a* and 36*a* and the second cable holding grooves 35*b* and 36*b*. The first cable 60 is sandwiched between the pair of slopes 19*a* of the first split housing 16 and the corresponding slopes 35*e* and 36*e* of the second split housing 30, from above and below. The second cable 65 is sandwiched between the pair of slopes 20*a* of the second split housing 30 and the corresponding slopes 35*f* and 36*f* of the second split housing 30, from above and below.

The connector 10 in a state of being loaded with the filler 70 will be mainly described below. The filler 70 is provided in each of the first split housing 16 and the second split housing 30 (a first filler 70*a* and a second filler 70*b*). When fitting the first split housing 16 and the second split housing 30 together, the first filler 70*a* and the second filler 70*b* may cement to each other so as to be integral, or stick to each other to form an interface. The filler 70 may be any material having cementing properties or sticking properties, such as a waterproof gel, a UV curing resin, or an adhesive.

Figure 10:
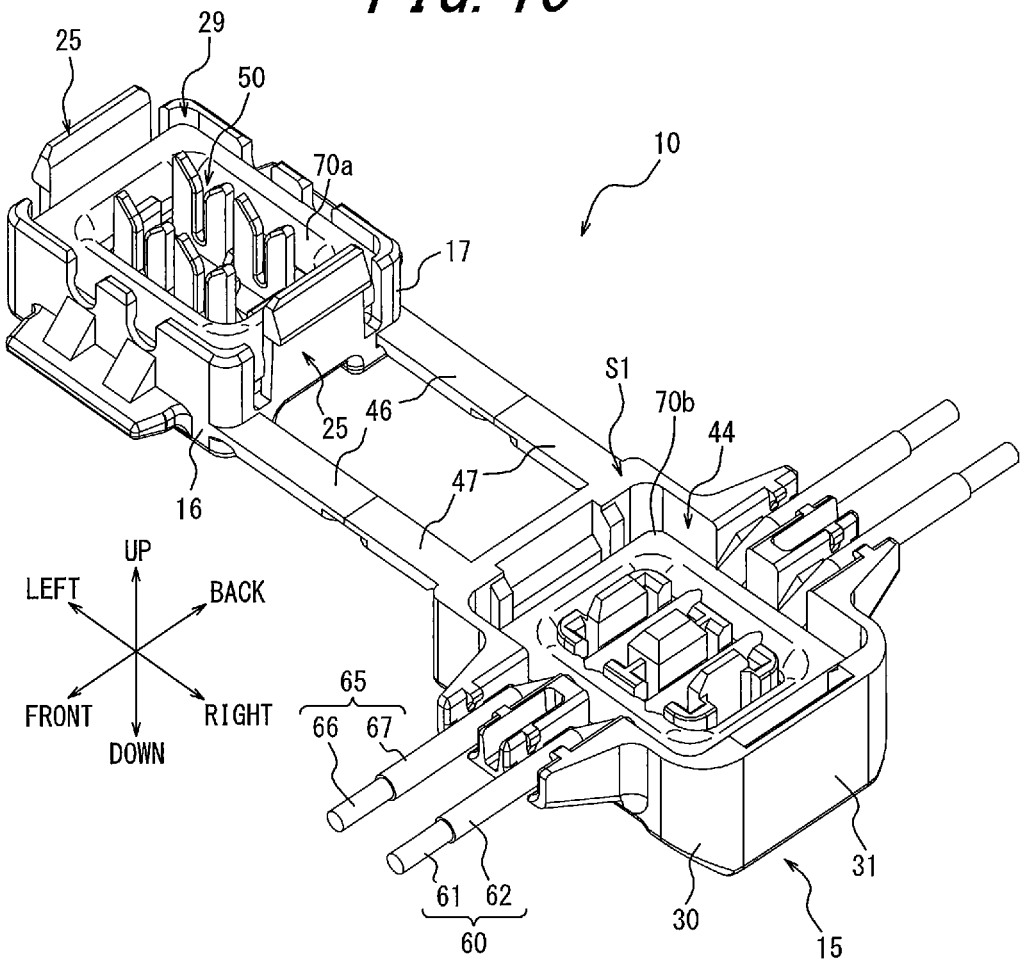
FIG. 10 is a perspective view illustrating a state in which the insulation housing in the expanded state is loaded with a filler.
Figure 11:
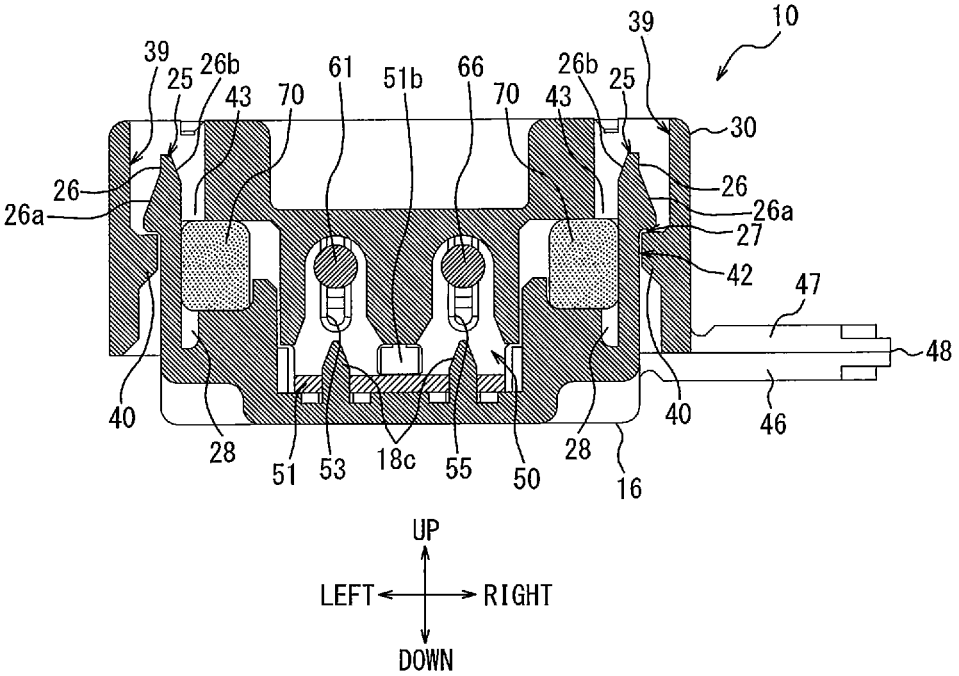
FIG. 11 is a sectional view illustrating the locked state of the connector loaded with the filler and corresponding to FIG. 9.
Figure 12:
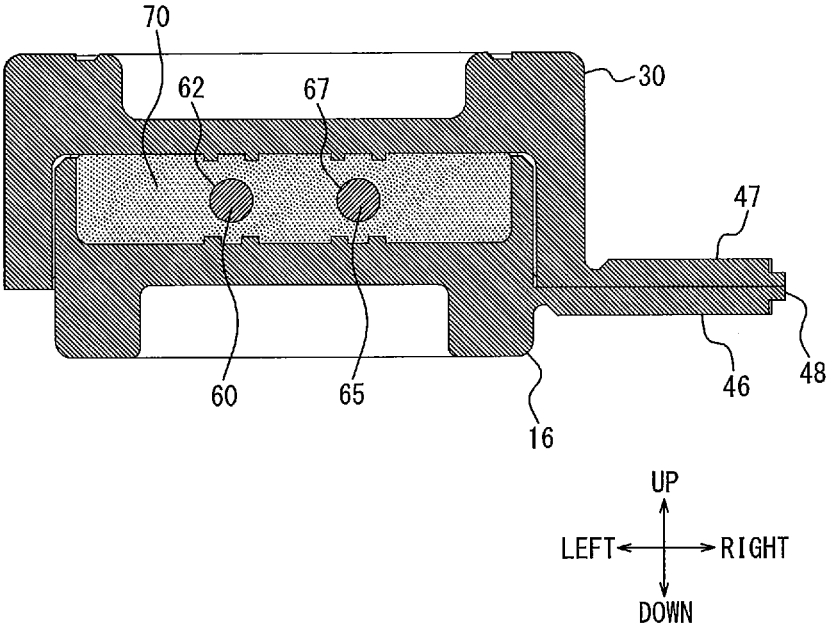
FIG. 12 is a sectional view along arrow XII-XII in FIG. 8 and illustrating the locked state of the connector loaded with the filler.

FIG. 10 is a perspective view illustrating a state in which the insulation housing 15 in the expanded state is loaded with the filler 70. FIG. 11 is a sectional view illustrating the locked state of the connector 10 loaded with the filler 70 and corresponding to FIG. 9. FIG. 12 is a sectional view along arrow XII-XII in FIG. 8 and illustrating the locked state of the connector 10 loaded with the filler 70.

In one embodiment, the filler 70 is interposed between the inner peripheral first facing surface 17*b* of the first split housing 16 and the inner peripheral second facing surface 31*b* of the second split housing 30, as illustrated in FIG. 10.

The first filler 70*a* provided on the inner peripheral first facing surface 17*b* of the first split housing 16 is formed in a square tube shape surrounding the relay contact 50, with its lower surface having a planar shape approximately the same as that of the inner peripheral first facing surface 17*b*. The height of the first filler 70*a* is a height at which the first filler 70*a* and the second filler 70*b* cement or stick to each other when the first split housing 16 and the second split housing 30 are fitted together.

Before the first split housing 16 and the second split housing 30 are fitted together, the first filler 70*a* is located in the first split housing 16 inward from the upper end (the end on the fitting side) of the first split housing 16. The first filler 70*a* is located in the first split housing 16 inward from the tip of the first locking portion 25. In other words, the upper surface of the first filler 70*a* is lower than the upper end of the first locking portion 25. Thus, the first filler 70*a* is located inside of the first opening 29 in the first split housing 16.

The second filler 70*b* provided on the inner peripheral second facing surface 31*b* of the second split housing 30 is formed in a square tube shape surrounding the cable pressing protrusion 32, with its lower surface having a planar shape approximately the same as that of the inner peripheral second facing surface 31*b*. The height of the second filler 70*b* is a height at which the first filler 70*a* and the second filler 70*b* cement or stick to each other when the first split housing 16 and the second split housing 30 are fitted together.

Before the first split housing 16 and the second split housing 30 are fitted together, the second filler 70*b* is located in the second split housing 30 inward from the upper end (the end on the fitting side) of the second split housing 30. The second filler 70*b* is located in the second split housing 30 inward from the upper surface of the outer peripheral wall 31 forming part of the first plane S1. In other words, the second filler 70*b* is located inside of the second opening 44.

When the connector 10 transitions from the expanded state illustrated in FIG. 10 to the locked state, the whole of the inside of the first split housing 16 and the second split housing 30 fitted together is filled with the filler 70, as illustrated in FIG. 11. In more detail, when the first split housing 16 and the second split housing 30 are in the locked state, the filler 70 adheres to the inner peripheral first facing surface 17*b* and the inner peripheral second facing surface 31*b* and encloses the relay contact 50.

In the locked state, the first filler 70*a* and the second filler 70*b* crush each other and are in one-time compressed state so as to reliably adhere to each other. In the case where the filler 70 is made of a material having cementing properties, the first filler 70*a* and the second filler 70*b* are integrated by a chemical reaction such as hydrogen bonding. In the case where the filler 70 is made of a material having sticking properties, the first filler 70*a* and the second filler 70*b* form an interface and stick to each other. Thus, the filler 70 provides a seal surrounding the relay contact 50.

The first cable 60 and the second cable 65 extend to the outside from the relay contact 50 located inside the filler 70 in the locked state. The first cable 60 and the second cable 65 extend to the outside from the press contact part in the relay contact 50 along the front-back direction.

The filler 70 surrounds the surfaces of the sheaths 62 and 67 of the first cable 60 and the second cable 65 so as to adhere to the surfaces of the sheaths 62 and 67, without interfering with the electrical conduction with the relay contact 50. When the first split housing 16 and the second split housing 30 are fitted together, the first cable 60 and the second cable 65 are located inside the first filler 70*a* and the second filler 70*b* in a sectional view along the fitting direction, i.e. the up-down direction, as illustrated in FIG. 12.

The first split housing 16 and the second split housing 30 respectively have spaces 28 and 43 into which an excess of the filler 70 enters in the case where the filler 70 is excessive (see FIG. 11). The spaces 28 and 43 are formed along the inner surfaces of the pair of first locking portions 25 and are located above and below the filler 70 in a state in which the first split housing 16 and the second split housing 30 are fitted together. Such spaces 28 and 43 can absorb and store an excess of the filler 70 in the locked state. The connector 10 can therefore suppress variations due to individual differences with regard to, for example, the pressing forces on the first cable 60 and the second cable 65.

The filler 70 abuts the inner surfaces of the pair of first locking portions 25 of the first split housing 16. As illustrated in FIG. 11, the position of an engagement surface 27 between the first locking protrusion 26 and the second locking protrusion 40 in the up-down direction is within the width of the filler 70 in the up-down direction. When the first split housing 16 and the second split housing 30 are fitted together, the surface of the second locking protrusion 40 abuts the outer surface of the first locking portion 25. An abutting surface 42 formed as a result is approximately parallel to the inner surface of the first locking portion 25 abutting the filler 70.

With the above-described structure of the filler 70, the connector 10 can effectively prevent entry of external foreign matter such as water or dust.

As a result of the filler 70 being located inside of the opening of each split housing in the connector 10, contact between the filler 70 and an external component or foreign matter can be prevented even during operation or transportation. Since the filler 70 is located inside, the filler 70 is kept from coming into contact with the below-described package body 100, and accordingly the connector 10 can be packed efficiently. The connector 10 packed in the package body 100 can be transported without the filler 70 being exposed to the outside. Consequently, the connector 10 can stably deliver predetermined performance of the filler 70 during use. The connector 10 forms the first plane S1, which contributes to more stable packing. By configuring the connector 10 so that the upper surface of at least half of the connector 10 in the extending region of the connector 10 forms the first plane S1, the connector 10 can be packed easily and stably because the first plane S1 is stably supported by the bottom surface of the package body 100. Therefore, the filler 70 can be appropriately protected in the connector 10 even during transportation.

In the connector 10, the first split housing 16 and the second split housing 30 protrude in opposite directions with respect to the first plane S1, which simplifies packing. By containing the first split housing 16 in a recess that is recessed in a stepwise manner from the bottom surface of the package body 100 that supports the first plane S1, the whole connector 10 can be packed appropriately.

In the connector 10, the first filler 70*a* and the second filler 70*b* are both located internally. Hence, the two fillers 70 necessary to achieve a sufficient waterproofing property can be protected appropriately. Such a connector 10 can prevent adhesion of external foreign matter such as water, dust, or oil to the filler 70, and suppress changes in the properties of the filler 70 caused by the external foreign matter. Thus, a predetermined cementing force or sticking force between the first filler 70*a* and the second filler 70*b* can be maintained in the connector 10, with it being possible to achieve an appropriate waterproofing property.

In the connector 10, the relay contact 50 is located inward from the end of the first split housing 16 on the fitting side, so that damage to the relay contact 50 caused by contact with an external component or foreign matter can be prevented. Damage to external components caused by contact with the relay contact 50 in the connector 10 can also be prevented. Thus, the connector 10 can appropriately protect the relay contact 50 and external components.

As described above, the connector 10 can achieve a sufficient waterproofing property, and also deliver excellent operability.

Since the filler 70 adheres to the first cable 60 and the second cable 65, even when the first cable 60 and the second cable 65 are shaken and bent by an external force exerted on the outside of the connector 10, movement or stress caused by such bending is prevented from being transmitted to the part in press contact with the relay contact 50. Contact reliability is thus maintained.

As a result of the filler 70 abutting the inner surface of the first locking portion 25, the elastic first locking portion 25 tries to elastically deform outward by an elastic force from the inside to the outside due to the expansion or swelling of the filler 70. Since the connector 10 has the locking portions inside, such outward elastic deformation can further strengthen the engagement between the first locking portion 25 and the second locking portion 39 in the connector 10. In more detail, as a result of the engagement surface 27 between the first locking protrusion 26 and the second locking protrusion 40 being located within the width in the up-down direction of the inner surface of the first locking portion 25 abutting the filler 70, the expansion force or the like of the filler 70 is efficiently converted into the engagement force. As a result of the abutting surface 42 being approximately parallel to the inner surface of the first locking portion 25 abutting the filler 70, the expansion force or the like of the filler 70 is transmitted in an approximately perpendicular direction with respect to the surfaces of the first locking portion 25 and the second locking protrusion 40. The expansion force or the like of the filler 70 is thus converted into the engagement force more efficiently. Consequently, the state of adhesion between the first split housing 16 and the second split housing 30 in the connector 10 can be enhanced. That is, even when an elastic force from the inside to the outside acts in the connector 10, opening of the first split housing 16 and the second split housing 30 can be suppressed. The connector 10 can therefore maintain waterproofing property. This effect is seen at normal temperatures but is more noticeable at high temperatures at which the expansion of the filler 70 is greater.

In the case where the filler 70 also has high viscosity, opening of the first split housing 16 and the second split housing 30 in the connector 10 can be further suppressed. As a result of the filler 70 being located on each of the inner surfaces of the first split housing 16 and the second split housing 30, the respective fillers 70 stick to each other in the locked state. This sticking force serves as resistance against opening of the first split housing 16 and the second split housing 30 when fitted together.

(Package body)

Figure 13:
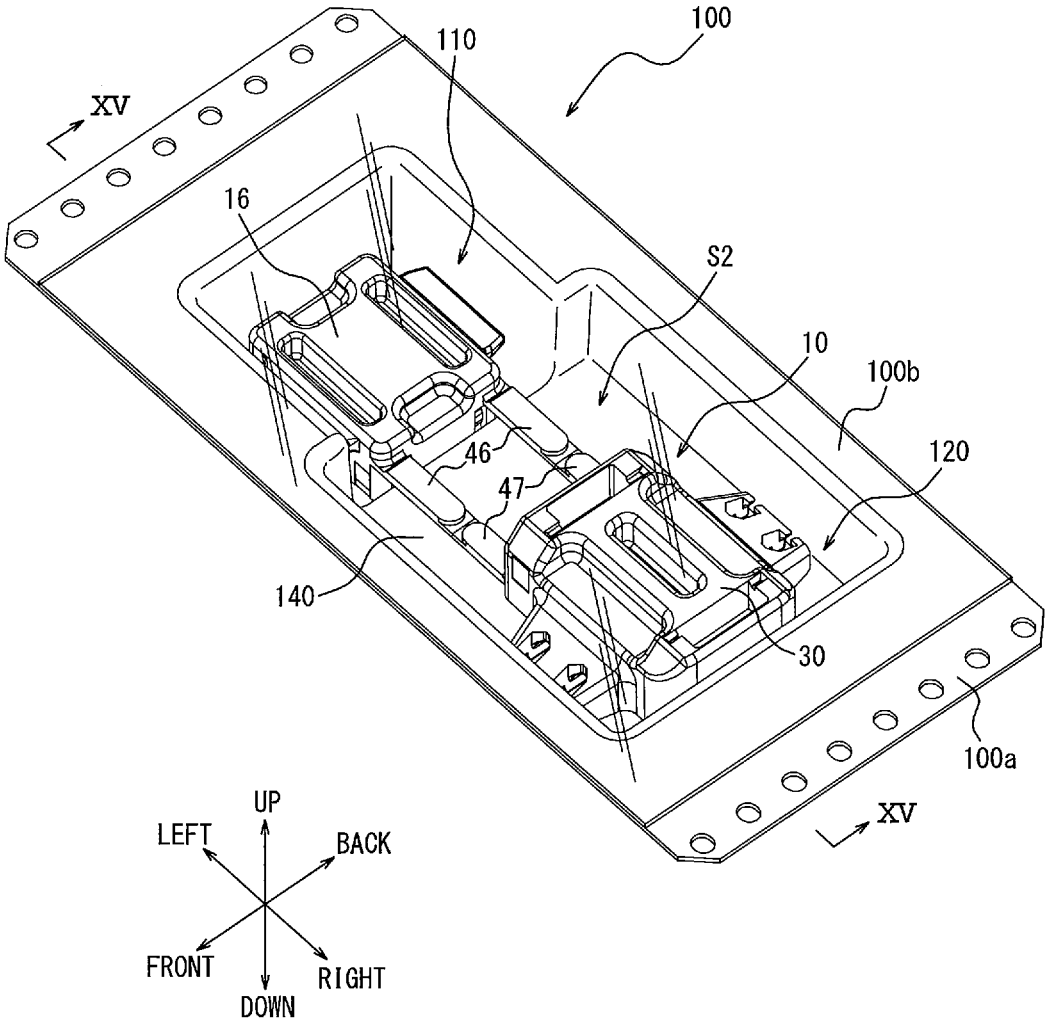
FIG. 13 is a perspective view of a package body illustrating the connector according to the embodiment in a contained state.
Figure 14:
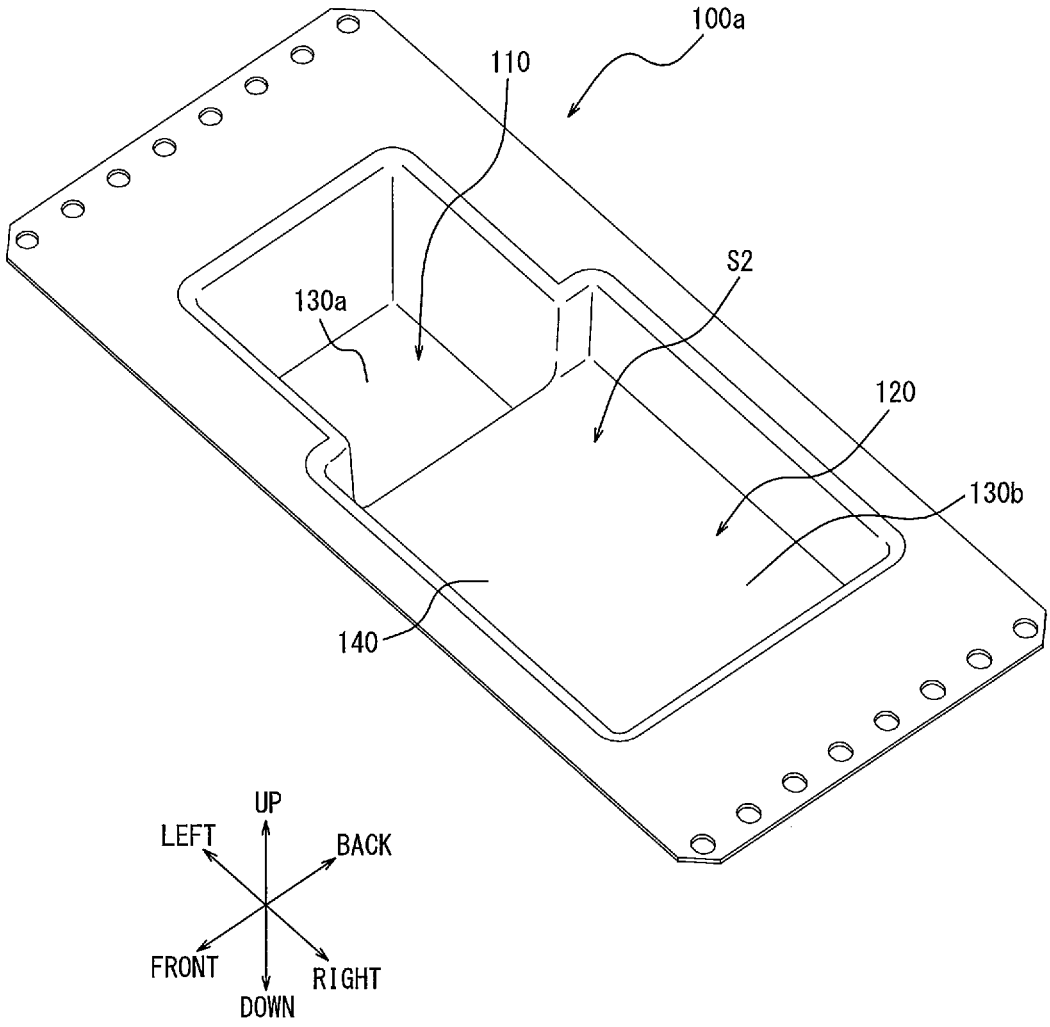
FIG. 14 is a perspective view of a base forming the package body in isolation.
Figure 15:
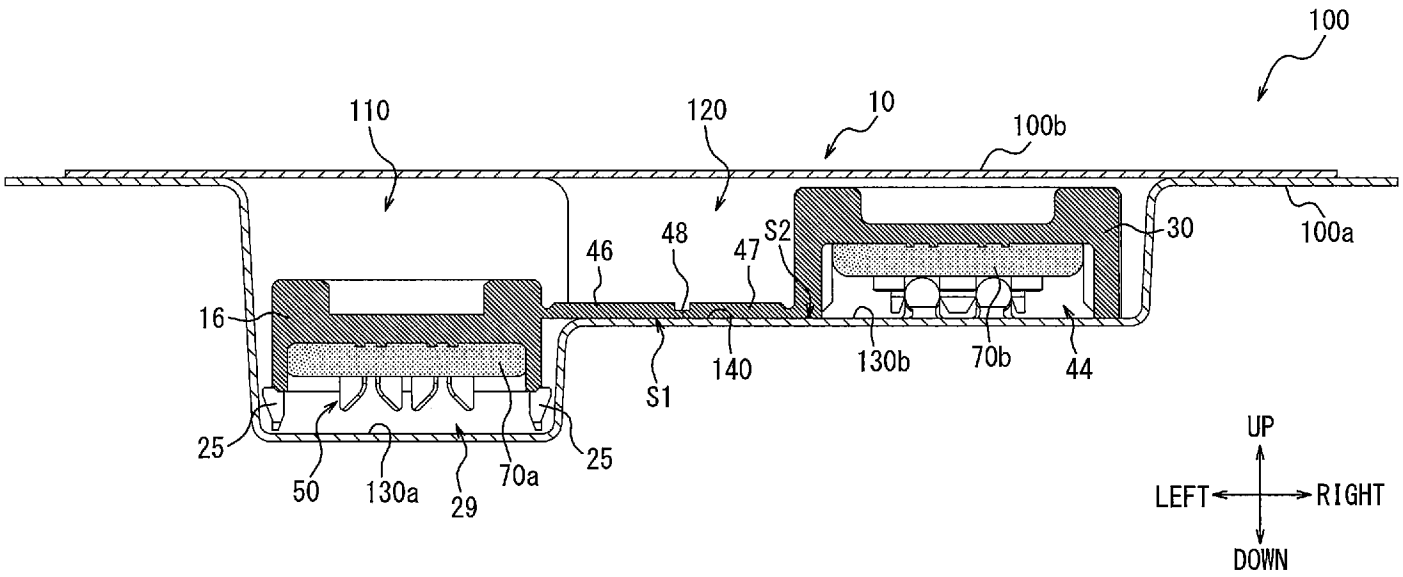
FIG. 15 is a sectional view along arrow XV-XV in FIG. 13.

The package body 100 for packing the connector 10 will be described below, with reference to FIGS. 13 to 15. FIG. 13 is a perspective view of the package body 100 in a state in which the connector 10 is being contained. FIG. 14 is a perspective view of a base 100*a* forming the package body 100 in isolation. FIG. 15 is a sectional view along arrow XV-XV in FIG. 13.

For example, the package body 100 is composed of the base 100*a* and cover tape 100*b*, as illustrated in FIG. 13. The connector 10 before the fitting of the first split housing 16 and the second split housing 30 is packed in the package body 100. The package body 100 contains the connector 10, which does not hold the first cable 60 and the second cable 65, in an upside-down state. The package body 100 contains the connector 10 in a state in which the base 100*a* covers the first opening 29 and the second opening 44 from below and the cover tape 100*b* covers the whole connector 10 from above. The connector 10 is packed in the package body 100 so as to be sandwiched between the base 100*a* and the cover tape 100*b*.

The package body 100, in particular the base 100*a*, is made of a light blocking material in order to suppress changes to the properties of the filler 70 inside the connector 10. For example, the base 100*a* is made of a black material. The base 100*a* may be coated with an antistatic agent to prevent adhesion of dust, or may be made of an antistatic material. For example, the base 100*a* may be made of a carbon-containing material to leak electric charge. The base 100*a* is, for example, formed by part of embossed carrier tape. The cover tape 100*b* may be made of a transparent material or may be made of a light blocking material. The cover tape 100*b* is, for example, formed by cover tape corresponding to the embossed carrier tape.

The base 100*a* has a first recess 110 (recess) and a second recess 120 at its center, as illustrated in FIG. 14. The first recess 110 and the second recess 120 are adjacent to each other. The first recess 110 is recessed downward from the second recess 120 in a stepwise manner. The first recess 110 and the second recess 120 are continuous to form one recess, and the whole of the connector 10 is contained in this recess. Specifically, the first recess 110 contains the first split housing 16, and the second recess 120 contains the second split housing 30, the first connection portions 46, and the second connection portions 47. The front-back widths of the first recess 110 and the second recess 120 approximately match the front-back widths of the first split housing 16 and the second split housing 30, respectively.

As illustrated in FIG. 15, the package body 100 has a first cover surface 130*a* that faces the first filler 70*a* provided inside the first split housing 16 and covers the first opening 29 in a state in which the connector 10 is packed in the package body 100. The first cover surface 130*a* is formed by the bottom surface of the first recess 110. The package body 100 also has a second cover surface 130*b* that faces the second filler 70*b* provided inside the second split housing 30 and covers the second opening 44 in a state in which the connector 10 is packed in the package body 100. The second cover surface 130*b* is formed by part of the bottom surface of the second recess 120. Thus, the first cover surface 130*a* and the second cover surface 130*b* are each formed by the bottom surface of the base 100*a*.

The package body 100 has a support surface 140 that supports the end surface of the second split housing 30 on the fitting side in the packed state. The support surface 140 supports the first plane S1 of the connector 10. The support surface 140 is approximately the same as the bottom surface of the second recess 120, excluding the second cover surface 130*b*. The first recess 110 is recessed downward from the support surface 140 in a stepwise manner.

When the connector 10 is contained in the package body 100, the first plane S1 is supported by the support surface 140 in an abutting state, and the second opening 44 is completely covered by the second cover surface 130*b*. The second cover surface 130*b* covering the second opening 44 and the support surface 140 form a common second plane S2.

When the connector 10 is contained in the package body 100, the first plane S1 abuts the support surface 140, and the tips of the first locking portions 25 in the first split housing 16 are approximately at the same position as the bottom surface of the first recess 110 in the up-down direction. The spacing between the first cover surface 130*a* covering the first opening 29 and the support surface 140 is approximately the same as the spacing between the end of the first split housing 16 on the fitting side and the first plane S1 including the end surface of the second split housing 30 on the fitting side.

Thus, the package body 100 contains the whole connector 10. The package body 100 covers the filler 70 and the relay contact 50 inside the connector 10 by the first cover surface 130*a* and the second cover surface 130*b* while being supported by the second plane S2.

The package body 100, as a result of being made of a light blocking material, can suppress changes to the properties of the filler 70 inside the connector 10. By covering the first opening 29 and the second opening 44 respectively with the first cover surface 130*a* and the second cover surface 130*b*, the package body 100 can suppress changes to the properties of the filler 70 due to external factors. In the case where the filler 70 is made of an ultraviolet-curing resin, the package body 100 can prevent exposure of the filler 70 to external light including ultraviolet light such as sunlight to thus maintain the quality of the filler 70 for the long term.

As a result of the package body 100 having the support surface 140 that supports the first plane S1 in the packed state, the connector 10 can be supported stably. By supporting at least half of the connector 10 by the abutment between the first plane S1 and the support surface 140, the package body 100 can reliably position the support surface 140 under the center of gravity of the connector 10. The package body 100 can therefore prevent the packed connector 10 from tilting or falling inside the package body 100 during transportation or the like. Thus, the package body 100 provides a stable package for the connector 10, and appropriately protects the filler 70 even during transportation.

As a result of the second cover surface 130*b* and the support surface 140 forming the common second plane S2, the package body 100 can cover the second opening 44 substantively without a gap. The package body 100 can therefore protect the second filler 70*b* more appropriately, and further suppress incoming light.

As a result of the package body 100 having the first recess 110 and the second recess 120, optimal packing according to the shape of the connector 10 can be achieved. By approximately matching the front-back widths, the right-left widths, and the depths of the first recess 110 and the second recess 120 respectively with the dimensions of the first split housing 16 and the second split housing 30, the package body 100 can stably contain the connector 10 in a state in which gaps are reduced to improve the light blocking effect. By forming the first recess 110 according to the level difference between the first split housing 16 and the second split housing 30, the package body 100 can prevent the packed connector 10 from tilting or falling inside the package body 100 during transportation or the like. By surrounding the first split housing 16 by the inner surface of the first recess 110 from the four directions of front, back, right, and left in the package body 100, the posture stability and the light blocking effect can be improved. With the structure of the second plane S2 and the first recess 110, the connector 10 can be packed in the package body 100 more stably.

The package body 100 can thus improve the posture stability and the light blocking effect for the connector 10.

In the case where the cover tape 100*b* is made of a light blocking material, the package body 100 can further improve the light blocking effect. By sandwiching the connector 10 between the base 100*a* and the cover tape 100*b*, the package body 100 can prevent the connector 10 from separating from the base 100*a*. The package body 100 can also prevent the connector 10 from rattling in the base 100*a*.

It is to be understood by a person of ordinary skill in the art that the disclosed technique may also be realized in specific forms other than the foregoing embodiments without departing from the technical spirit or essential features of the present disclosure. Therefore, the above description is illustrative and not restrictive. The scope of the present disclosure is defined by the accompanying claims rather than by the above description. Amongst all modifications, those falling within the corresponding equivalent scope are encompassed within the scope of the present disclosure.

Although the relay contact 50 is of a type that clamps (i.e. press contacts) the second cable 65, the relay contact 50 may be of a type that crimps the second cable 65. In this case, the second cable 65 is crimp-connected to the relay contact 50 beforehand and, in this state, the relay contact 50 is mounted in the first split housing 16. In this embodiment, a cable crimp terminal is formed instead of one of the pair of the first press-contact groove 53 and the second press-contact groove 55 in the relay contact 50. One cable support arm portion 35 or 36 corresponding to the remaining press-contact groove is provided in the second split housing 30.

Alternatively, three or more cables arranged in a direction orthogonal or approximately orthogonal to the extending direction of the portion of each cable supported by the connector 10 may be connected by the connector 10. In this case, three or more pairs of press-contact grooves (arranged in the right-left direction) may be formed in one relay contact. Press-contact grooves may be formed in each of a plurality of relay contacts in such a manner that at least one relay contact has two or more pairs of press-contact grooves, and the cables (core wires) may be clamped by these press-contact grooves.

Although the above describes the case where the first split housing 16 and the second split housing 30 are respectively filled with the first filler 70*a* and the second filler 70*b*, the present disclosure is not limited to such. The connector 10 may be configured so that only one of the first split housing 16 and the second split housing 30 has the filler 70, as long as an appropriate waterproofing property can be obtained.

Although the above describes the case where the spacing between the first cover surface 130*a* and the support surface 140 is approximately the same as the spacing between the end of the first split housing 16 on the fitting side and the first plane S1, the present disclosure is not limited to such. The position of the first cover surface 130*a* in the up-down direction may be any position at which the light blocking effect for the first split housing 16 and the posture stability for the connector 10 can be maintained.

The package body 100 may be formed by embossed carrier tape having successive pockets of the pocket shape illustrated in FIG. 13 so that a plurality of connectors 10 can be delivered together. Alternatively, the package body 100 may be formed by emboss carrier tape having one pocket of the pocket shape illustrated in FIG. 13 so that a single connector 10 can be delivered. In such a case, for example, a package of a single connector 10 may be provided by cutting the emboss carrier tape having successive pockets of the pocket shape per pocket.

REFERENCE SIGNS LIST

10 connector
15 insulation housing
16 first split housing (first fitting object)
17 outer peripheral wall
17*a* inner peripheral recess
17*b* inner peripheral first facing surface
17*c* central first recess
17*d* central first facing surface
18 contact mounting groove
18*a* fixed portion
18*b* intermediate projection
18*c* positioning protrusion
19 first cable mounting groove
19*a* slope
20 second cable mounting groove
20*a* slope
21, 22 lid portion
21*a*, 22*a* facing surface
25 first locking portion
25*a* recess
26 first locking protrusion
26*a*, 26*b* slope
27 engagement surface
28 space
29 first opening
30 second split housing (second fitting object)
31 outer peripheral wall
31*a* inner peripheral recess
31*b* inner peripheral second facing surface
32 cable pressing protrusion
32*a* first pressing groove
32*b* second pressing groove
32*c* central protrusion
32*d*, 32*e* protrusion
35, 36 cable support arm portion
35*a*, 36*a* first cable holding groove
35*b*, 36*b* second cable holding groove
35*c*, 36*c* anti-dropout protrusion
35*d*, 36*d* anti-dropout protrusion
35*e*, 36*e* slope
35*f*, 36*f* slope
37*a*, 37*b*, 38*a*, 38*b* protrusion part
39 second locking portion
40 second locking protrusion
41 projection wall
42 abutting surface
43 space
44 second opening
46 first connection portion (connection portion)
47 second connection portion (connection portion)
48 bendable portion
50 relay contact (contact)
51 base piece
51*a* positioning hole
51*b* play portion
52 first cable press-contact piece
52*a* tip
52*b* narrow portion
53 first press-contact groove (electrically conductive portion, press-contact groove)
54 second cable press-contact piece

54*a* tip
54*b* narrow portion
55 second press-contact groove (electrically conductive portion, press-contact groove)
60 first cable (cable)
61 core wire
62 sheath
65 second cable (cable)
66 core wire
67 sheath
70 filler
70*a* first filler
70*b* second filler
100 package body
100*a* base
100*b* cover tape
110 first recess (recess)
120 second recess
130*a* first cover surface
130*b* second cover surface
140 support surface
S1 first plane
S2 second plane

The invention claimed is:

1. A package comprising:

a connector including: a pair of a first fitting object and a second fitting object; a connection portion connecting said first fitting object and said second fitting object so that said first fitting object protrudes more to a fitting side than said second fitting object; a first opening and a second opening formed respectively in said first fitting object and said second fitting object and opened to the fitting side in a same direction; and a filler located inside of an opening in at least one of said first fitting object and said second fitting object; and a package body including a base which contains said connector, said base having a first surface facing said first opening and a second surface facing said second opening and said connection portion, wherein said first surface is formed deeper than said second surface in said base relative to a direction in which said connector is contained with respect to said base.

2. The package according to claim 1, wherein said package body further includes a cover material that covers said first fitting object and said second fitting object on a side opposite to said first opening and said second opening and is attached to said base.

3. The package according to claim 1, wherein an end surface of said second fitting object on the fitting side and a surface of said connection portion form a common first plane.

4. The package according to claim 3, wherein said base has a support surface that supports said first plane.

5. The package according to claim 4, wherein a spacing between said first surface facing said first opening and said support surface is approximately same as a spacing between an end of said first fitting object on the fitting side and said end surface of said second fitting object on the fitting side.

6. The package according to claim 4, wherein said second surface facing said second opening and said support surface form a common second plane.

7. The package according to claim 1, wherein said filler is located inside of said opening in each of said first fitting object and said second fitting object.

8. The package according to claim 1, wherein one fitting object of said first fitting object and said second fitting object includes a contact having an electrically conductive portion, and in an expanded state of said first fitting object and said second fitting object, said contact is located inward from an end of the fitting object on the fitting side.

9. The package according to claim 8, wherein said electrically conductive portion is a press-contact groove, and in a state in which said first fitting object and said second fitting object are fitted together, said contact clamps a core wire of each of at least two cables by said press-contact groove to bring said at least two cables into conduction with each other.

* * * * *